US009567698B2

(12) United States Patent
Dilo

(10) Patent No.: US 9,567,698 B2
(45) Date of Patent: Feb. 14, 2017

(54) NEEDLE BOARD

(71) Applicant: Oskar Dilo Maschinenfabrik KG, Eberbach (DE)

(72) Inventor: Johann Philipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

(21) Appl. No.: 14/945,705

(22) Filed: Nov. 19, 2015

(65) Prior Publication Data

US 2016/0069006 A1 Mar. 10, 2016

Related U.S. Application Data

(63) Continuation of application No. 14/640,089, filed on Mar. 6, 2015, now Pat. No. 9,260,806.

(30) Foreign Application Priority Data

Mar. 13, 2014 (EP) ..... 14159491

(51) Int. Cl.
*D04H 18/02* (2012.01)
*D04H 1/46* (2012.01)

(52) U.S. Cl.
CPC ..... *D04H 18/02* (2013.01); *D04H 1/46* (2013.01)

(58) Field of Classification Search
CPC ..... D04H 18/02; D04H 1/46; D04H 18/00; D04H 17/00; D05C 11/04; D05C 15/145
USPC ..... 28/115, 114, 107, 109, 111; 112/80.4, 112/80.41, 80.45
See application file for complete search history.

(56) References Cited

U.S. PATENT DOCUMENTS 2,896,303 A * 7/1959 Morrill ..... D04H 18/02 28/115
3,606,654 A * 9/1971 Dilo ..... D04H 18/00 28/115
3,877,120 A * 4/1975 Okamoto ..... D04H 18/02 28/115
5,148,584 A * 9/1992 Fehrer ..... D04H 18/00 28/115
5,295,450 A * 3/1994 Neely ..... D05C 15/22 112/80.45
2010/0162543 A1 7/2010 Dilo
(Continued)

FOREIGN PATENT DOCUMENTS

GB 399104 A * 9/1933 ..... D04H 18/02
JP 11350327 A * 12/1999

OTHER PUBLICATIONS

English language machine translation of JP 11350327 (pub. Dec. 1999), 16 pages.*

*Primary Examiner* — Amy Vanatta
(74) *Attorney, Agent, or Firm* — Jansson Munger McKinley & Kirby Ltd.

(57) ABSTRACT

A method for homogenizing the stitching pattern in a needled fleece requires a detector which is arranged between a first needling device and a second needling device and detects areas in the fleece where stitches are absent. Then the fleece needled by the first needling device is also needled in the second needling device, wherein at least one operating parameter or at least one structure parameter of the second needling device is adapted specifically on the basis of the result of the detection of the absent-stitch areas, so that, during the further needling of the fleece in the second needle machine, the absent-stitch areas are filled in a targeted manner.

6 Claims, 9 Drawing Sheets

(56) References Cited

U.S. PATENT DOCUMENTS

| | | | | |
|---|---|---|---|---|
| 2010/0251525 | A1* | 10/2010 | Haussler | D04H 18/02 28/115 |
| 2011/0041303 | A1* | 2/2011 | Haussler | D04H 18/02 28/115 |
| 2014/0261121 | A1* | 9/2014 | Woodall | D05C 15/10 112/80.45 |
| 2014/0310928 | A1 | 10/2014 | Kuhl | |

* cited by examiner

NEEDLE BOARD

CROSS-REFERENCE TO RELATED APPLICATIONS

The present application is a continuation of pending U.S. patent application Ser. No. 14/640,089, filed Mar. 6, 2015, which claims priority to European Patent Application No. EP 14 159 491.1, filed Mar. 13, 2014, the contents of which are incorporate by reference in their entireties.

FIELD OF THE INVENTION

The present invention relates to a method for homogenizing the stitching pattern in a needled fleece.

BACKGROUND OF THE INVENTION

In needling technology, there is a known phenomenon that the needles, permanently arranged in the needle board in a certain fixed pattern, lead to a stitching pattern in the surface of the fleece which is dependent on the horizontal feed of the fleece per vertical stroke of the needles which stitch the fleece. In addition, it is possible for longitudinal distortions to occur in the fleece web during needling. Also to be mentioned are transverse "jumps" which influence this stitching pattern. More-or-less uniform stitching can be produced only in a few feed ranges. It is often possible, however, to observe the occurrence of transverse stripes, longitudinal stripes, diagonals, or actual patternings in which the stitches are not equidistant from each other. Instead of such equidistance, there is an excessive number of stitches in certain areas and an absence of stitches in others. Such stitching patterns are damaging to the quality of the end product with respect to strength, density, wear resistance, and surface uniformity.

It is an object of the present invention to make the arrangements of the stitching points in a needled fleece more uniform and thus to arrive at a more homogeneous stitching pattern.

SUMMARY OF THE INVENTION

According to an aspect of the invention, the method for homogenizing the stitching pattern in a needled fleece comprises the following steps:

- providing a first needling device and a second needling device, arranged in series, wherein each needling device comprises a plurality of needles fastened to at least one movable needle board for needling a supplied fleece;
- needling the supplied fleece in the first needling device, as a result of which a plurality of stitches is produced in the fleece;
- detecting, at a location between the first needling device and the second needling device, absent-stitch areas in the fleece where stitches are absent; and
- subjecting the fleece needled by the first needling device to additional needling in the second needling device, wherein at least one operating parameter and/or at least one structure parameter of the second needling device is adapted on the basis of the result of the detection of absent-stitch areas in such a way that, during the further needling of the fleece in the second needling device, at least parts of the absent-stitch areas are filled in a targeted manner.

In this way it is possible, with the help of electronic support, to at least clearly improve the homogeneity of the stitching pattern in a needled fleece.

In a preferred embodiment, the adaptation of the at least one operating parameter and/or of the at least one structure parameter of the second needling device is carried out by means of automatic control or feedback control. As a result, there is no need for the operator to carry out any manual adjusting work or to conduct burdensome and tedious test runs.

The at least one operating parameter of the second needle machine comprises, for example, the feed of the fleece per stroke of the at least one needle board. Because the range within which the transport speed of the fleece can be varied is relatively narrow, the desired adjustment is usually achieved instead by adapting the vertical stroke frequency of the drive for the needle board.

The at least one operating parameter of the second needling device can also comprise the phase of the vertical drive of the at least one needle board. In this way, a difference can be produced between the phase of the vertical drive of the needle board in the first needling device and the phase of the drive of the needle board in the second device. By adjusting this phase while simultaneously keeping the transport speed of the fleece through the second needling device constant, the stitching positions of the needles in the second needling device can be varied.

The at least one structure parameter of the second needling device can comprise the distance between the second needling device and the first needling device in a transport direction of the fleece. It is especially preferable for this distance to be adjustable while the machine is in operation.

The at least one structure parameter of the second needling device can also comprise the lateral positioning of the at least one needle board in the second needling device transversely to the transport direction of the fleece. This is advantageous especially in cases where longitudinal stripes are present in the fleece downstream from the first needling device. It is advantageous that the at least one needling board in the second needling device can be shifted laterally while the machine is operating.

In a special embodiment, the at least one structure parameter of the second needling device can also comprise the arrangement of the needles in the at least one needle board. As a result of this variability of the needle arrangement, it is possible to compensate for almost any pattern found in the stitching of the fleece.

In a preferred embodiment, the needles in the area of the at least one needle board are shiftable horizontally. As a result, the needle arrangement in the needle board can be adjusted in an especially simple and controlled manner.

It is preferable for the at least one needle board to comprise a base plate and a plurality of needle modules mounted on the base plate, each module comprising a carrier element, which is equipped with one or a plurality of needles, wherein the individual needle modules can be shifted horizontally in the needle board. The carrier element can consist of a plastic, which is injection-molded around the needles.

Alternatively, the second needling device can comprise at least one magnetic plate on a needle bar, this magnetic plate serving to hold or release needles, needle modules, and/or needle board segments on the side opposite the tips of the needles. As a result, it is possible to arrange the needles in the second needling device in a highly variable manner. This arrangement also offers the additional advantage that the magnetic plate automatically attracts all of the needles, needle modules, and/or needle board segments simultaneously without the need for any additional fastening elements.

It is also conceivable that the needles in the at least one needle board could be shiftable vertically. In this way, certain needles in the second needling device can, during a given vertical stroke, enter the fleece to be consolidated, whereas other needles, which have been pulled back somewhat farther into the needle board, do not engage in the fleece during the vertical stroke and therefore produce no stitches in the fleece.

The detection of areas of the fleece where stitches are absent is preferably done by means of an optoelectronic method, especially by means of a digital scan of the surface of the needled fleece. A CCD camera, for example, can be used for this purpose.

In a preferred embodiment, the adaptation of the at least one operating parameter and/or of the at least one structure parameter of the second needling device is carried out with the help of data filed in an electronic library. By comparison with these stored empirical values, the intelligent system can offer a proposal for how to adapt the at least one operating parameter and/or the at least one structure parameter of the second needle machine and can actuate or even automatically control this adaptation.

The homogeneity of the stitching in the needled fleece is preferably detected downstream from the second needling device by means of, for example, an optoelectronic method. In this way, the result of the adaptation of the at least one operating parameter and/or of the at least one structure parameter of the second needling device can be checked on the basis of the end result achieved.

In an especially preferred embodiment, the results of the detection of the homogeneity of the stitching in the needled fleece downstream from the second needling device are also used to fine-tune the adaptation of the at least one operating parameter and/or of the at least one structure parameter of the second needling device. This result is fed back to the control unit of the second needling device. In other words, fully automatic, self-adjusting control is achieved by this means.

BRIEF DESCRIPTION OF THE DRAWINGS

Additional features and advantages of the invention can be derived from the following description, which refers to the drawings.

DETAILED DESCRIPTION OF SPECIFIC EMBODIMENTS

Figure 1:
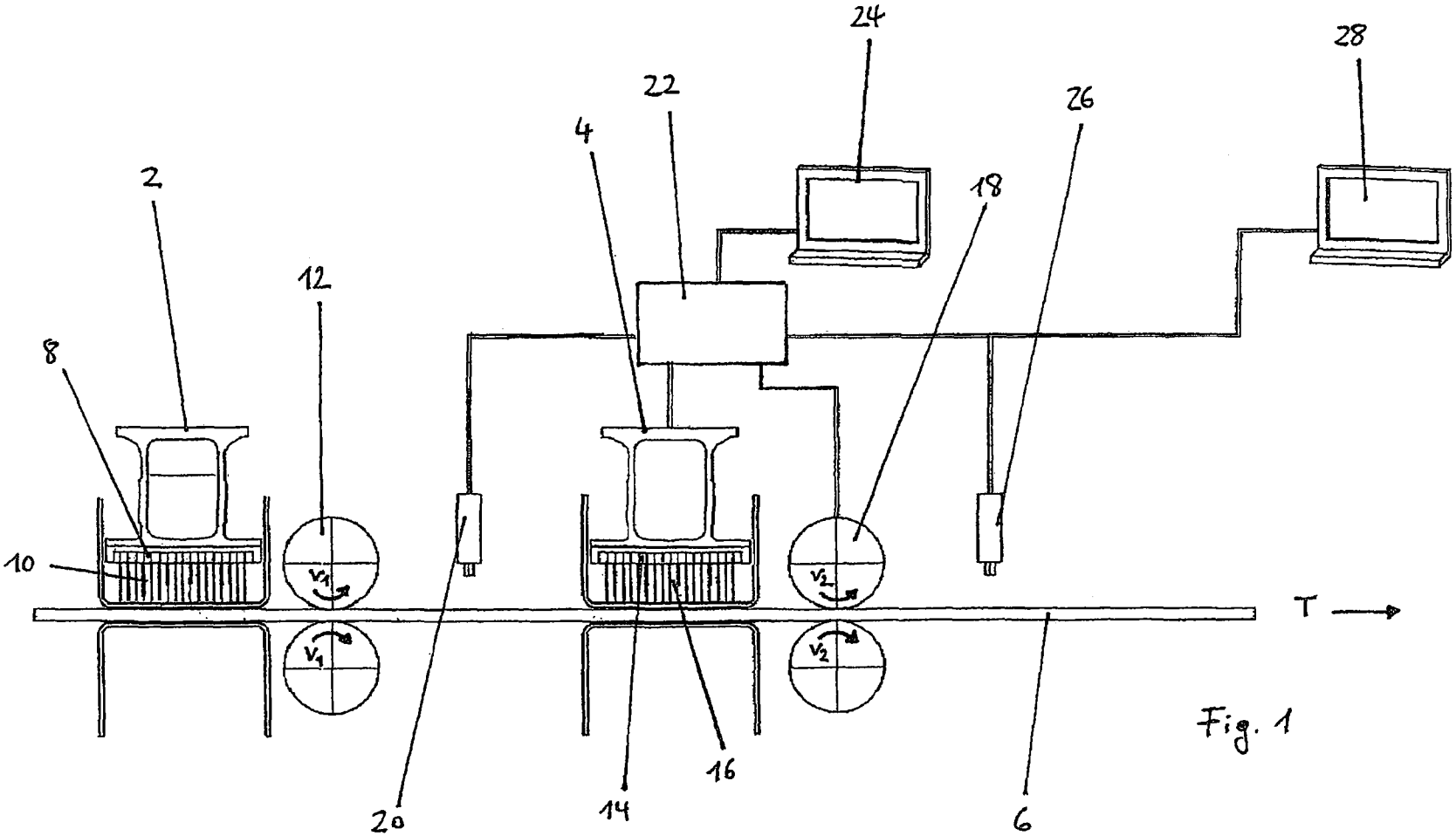
FIG. 1 is a schematic view of a system for implementing the method according to the invention for homogenizing the stitching in a needled fleece.

FIG. 1 shows in schematic fashion an example of a machine for implementing the method according to the invention for homogenizing the stitching pattern in a needled fleece. The machine comprises a first needling device 2 and a second needling device 4, which are arranged in series in the transport direction T of the fleece 6 and serve to needle the fleece 6. The first needling device 2 comprises at least one movable needle board 8, on which needles 10 are mounted for needling the supplied fleece 6. Downstream from the first needling device 2, a draw-off device 12 for the fleece 6 is provided, here in the form of two counter-rotating draw-off rolls, which are driven at a speed $v_1$.

The second needling device 4 also comprises at least one movable needle board 14, on which needles 16 are mounted for the further needling of the fleece 6, which has already been needled in the first needling device 2. Downstream from the second needling device 4 there is in turn a draw-off device 18, preferably consisting of a pair of counter-rotating draw-off rolls, which draw the fleece 6 from the second needling device 4 at a speed $V_2$. The draw-off speed $V_2$ of the draw-off device 18 is somewhat higher than the draw-off speed $V_1$ of the draw-off device 12.

The term "needling device" can, within the scope of the present invention, refer both to a needle machine with a single driven needle board and to a needle machine with two needle boards, one of which is arranged above, the other below, the fleece 6 to be needled and the needles of which therefore move toward and away from each other. The term "needling device" can also refer to a needle machine with several needle boards arranged in a row above and/or below the fleece 6 and also to corresponding needle machines with several pairs of needle boards arranged above and/or below the fleece 6.

Finally, the term "needling device" can also refer to a single needle board or to a specific pair of needle boards within a needle machine, even if the needle machine also comprises at least one other needle board in addition to the previously mentioned needle board or the previously mentioned needle boards. What this means, in other words, is that the term "needling device" can refer to all of the needle assemblies within a needle machine or to only certain assemblies within a plurality of needle assemblies in the same needle machine. The method according to the invention can be carried out in all these cases under consideration of the various ways in which the term "needling device" can be interpreted.

At a location between the first needling device 2 and the second needling device 4, a detector 20 is set up to detect absent-stitch areas where stitches are absent in the fleece 6 previously needled by the first needling device 2. The detector 20 is therefore arranged downstream from the first needling device 2, namely, either in an area downstream from the draw-off device 12 as shown in FIG. 1, or at a location between the first needling device 2 and its associated draw-off device 12. The detector 20 is preferably configured as an optoelectronic sensor, such as a CCD camera, which carries out a digital scan of the surface of the needled fleece 6.

The detector 20 is connected to a control unit 22, which evaluates the results of the detection of the absent-stitch areas in the fleece 6 and on that basis calculates a suitable adaptation of at least one operating parameter and/or of at least one structure parameter of the second needling device 4, so that, during the further needling of the fleece 6 in the second needling device 4, at least parts of the absent-stitch areas are filled up in a targeted manner. Concrete examples of the at least one operating parameter and of the at least one structure parameter of the second needling device 4 are explained in detail further below in addition to possible ways in which they can be adapted.

The control unit 22 can provide or use the information for suitably adapting the at least one operating parameter and/or the at least one structure parameter of the second needling device 4 in many different ways. For example, operating instructions for an operator can be displayed on a screen 24, instructing him how specifically to adjust manually the at least one operating parameter and/or the at least one structure parameter of the second needling device 4. It is also possible for the control unit 22 not only to calculate automatically, on the basis of stored data and rules stored in, for example, an electronic library, a suitable adaptation of the at least one operating parameter and/or of the at least one structure parameter of the second needling device 4 but also to undertake the corresponding adjustment by itself. The screen 24 can in this latter case serve to display information to the operator or can be eliminated entirely.

In a preferred embodiment, an additional detector 26 for detecting the homogeneity of the stitching in the needled fleece 6 is arranged downstream from the second needling device 4. This second detector serves to check the final result of the needling process. The detector 26 is preferably an optoelectronic sensor, such as a CCD camera, by means of which the homogeneity of the stitching in the needled fleece 6 can be determined. The images recorded by the detector 26 are preferably transmitted to another screen 28 or to the first screen 24. It is especially preferable for the results of the detector 26 to be sent to the control unit 22, as a result of which a feedback control loop is created. The control unit 22 can therefore use this information in the process of adapting the least one operating parameter and/or the at least one structure parameter of the second needling device 4. It is preferred that, on the basis of the feedback of the results obtained by the detector 26 to the control unit 22, it be necessary only to fine-tune the at least one operating parameter and/or the at least one structure of the second needling device 4 until a satisfactory result in the finished, stitched fleece 6 is obtained.

The method according to the invention unfolds as follows. First, the fleece 6 is transported through the first needling device 2, in which a first needling of the fleece 6 takes place. The operating parameters of the first needling device 2 are adjusted to desired, previously determined values. Then absent-stitch areas in which stitches are absent in the fleece are detected by means of the detector 20 at a location between the first needling device 2 and the second needling device 4. Finally, the fleece 6 previously needled by the first needling device 2 is subjected to further needling in the second needling device 4, wherein, on the basis of the result of the detection of absent-stitch areas in the fleece 6 by the detector 20, at least one operating parameter and/or at least one structure parameter of the second needling device 4 is adapted in such a way that, during the further needling of the fleece 6 in the second needling device 4, at least parts of the absent-stitch areas are filled in a targeted manner. In this way, the stitching in the needled fleece 6 can be homogenized, and the product quality of the finished, needled fleece 6 can be improved.

In the following, preferred operating parameters and structure parameters of the second needling device 4 will be explained, and possible ways of adapting them will be described by way of example.

One possible operating parameter of the second needling device 4 which can be adapted to homogenize the stitching in the needled fleece 6 is the horizontal feed of the fleece 6 per vertical stroke of the at least one needle board 14 of the second needling device 4. For this purpose, for example, the speed $V_2$ of the draw-off device 18 can be influenced (see FIG. 1). If the stroke required of the needle board 14 remains the same, a higher or lower draw-off speed $V_2$ changes the ratio of feed to stroke in the second needling device 4. Relatively large changes in the speed $V_2$ of the draw-off device 18, however, necessarily have effects on the throughput of the overall machine, which is usually previously determined and should not be changed. To this extent, the operating parameter "feed per stroke" of the second needling device 4 is usually adjusted by varying the vertical stroke frequency of the second needling device 4 in the first line. The control unit 22 can for this purpose preferably act directly on the drive 30 (FIG. 2) of the needle board 14 of the second needling device 4. The operating parameter "feed per stroke" can also be adapted while the machine is in operation.

Figure 2:
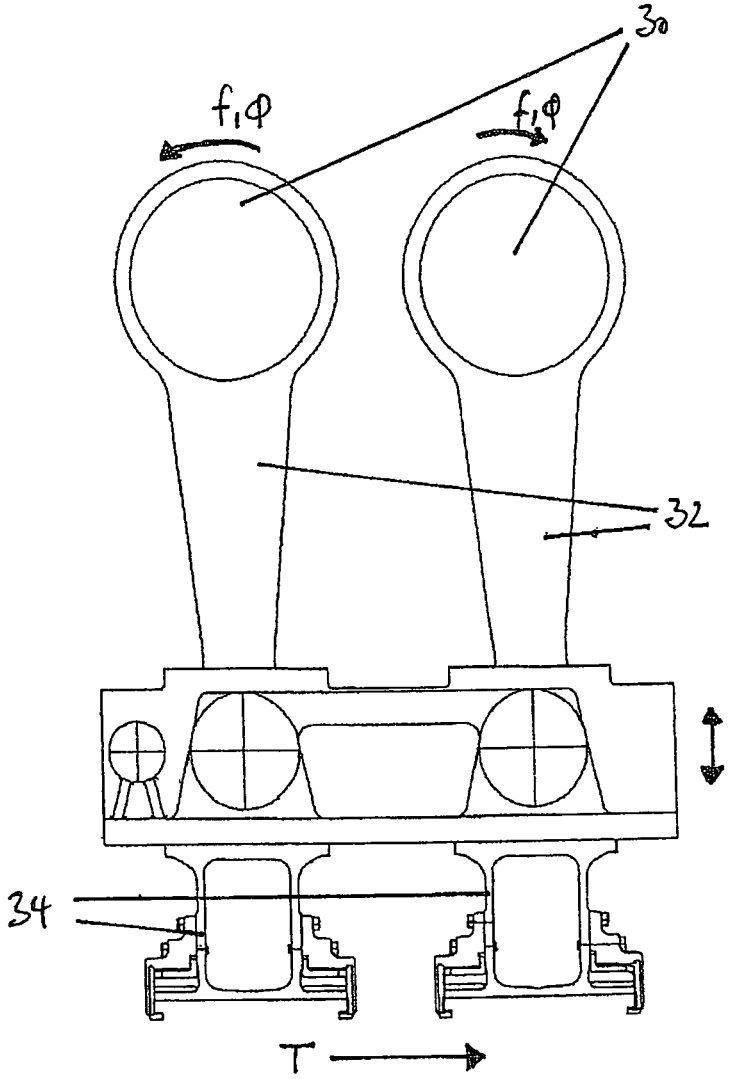
FIG. 2 is a schematic cross-sectional view of a needle assembly in the second needling device.

FIG. 2 shows an example of the configuration of a second needling device 4. Basically, at least one vertical conrod 32 is moved cyclically up and down by a cam drive 30. The at least one vertical conrod 32 is usually articulated to a needle bar 34, to which in turn the needle board 14 (not shown in FIG. 2) is fastened. In the embodiment shown in FIG. 2, the second needling device 4 is configured as a double needle machine, comprising two vertical conrods 32 and two needle bars 34, on which needle boards 14 are mounted, arranged in series in the transport direction T of the fleece 6. In the present case, the two needle bars 34 move synchronously. To adapt the operating parameter "feed per stroke", therefore, preferably the stroke frequency f of the cam drive 30 is changed. The second needling device 4 can also readily comprise, however, a different number of vertical conrods 32 and needle bars 34 (especially only one conrod and one needle bar).

In the embodiment of the second needling device 4 shown in FIG. 2, it is also possible to give the movement of the needle bars 34 a cyclical component involving horizontal back-and-forth strokes in the transport direction T of the fleece 6. It is advantageous here for this horizontal stroke component to be synchronized with the draw-off speed $V_2$ of the draw-off device 18 to avoid distortions in the fleece 6. The method according to the invention is also applicable to any other type of needling device, however, especially including those which have only a small horizontal stroke component or none at all.

Another operating parameter of the second needling device 4 which can be adapted for the purpose of homogenizing the stitching of the needled fleece 6 is the phase $\phi$ of the vertical drive 30 of the at least one needle board 14. Of particular interest is the phase difference between the cyclical movement of the second needling device 4 and the cyclical movement of the first needling device 2. A phase shift of 180° means in this context that the second needling device 4 reaches the highest point of its vertical stroke precisely when the first needling device 2 reaches the lowest point of its vertical stroke. Through the adjustment of the phase $\phi$ of the second needling device 4, the stitching of the finished, stitched fleece 6 can be subjected to significant effects. The adjustment of the operating parameter "phase of the vertical drive" in the second needling device 4 can easily be carried out while the machine is in operation.

Figure 3A:
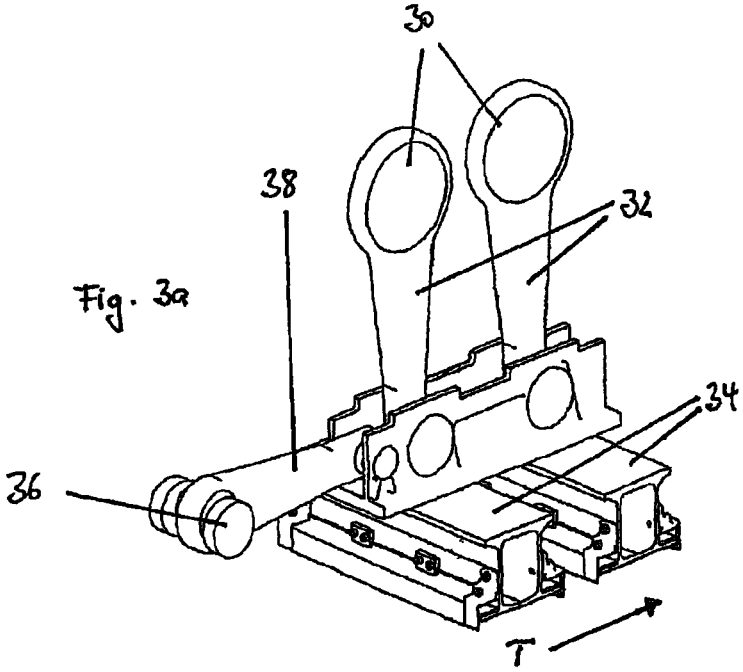
FIGS. 3*a* and 3*b* are two different views of a needle assembly in the second needling device similar to that of FIG. 2, wherein a horizontal shift of the needle board of the second needling device in a transport direction of the fleece is also possible.
Figure 3B:
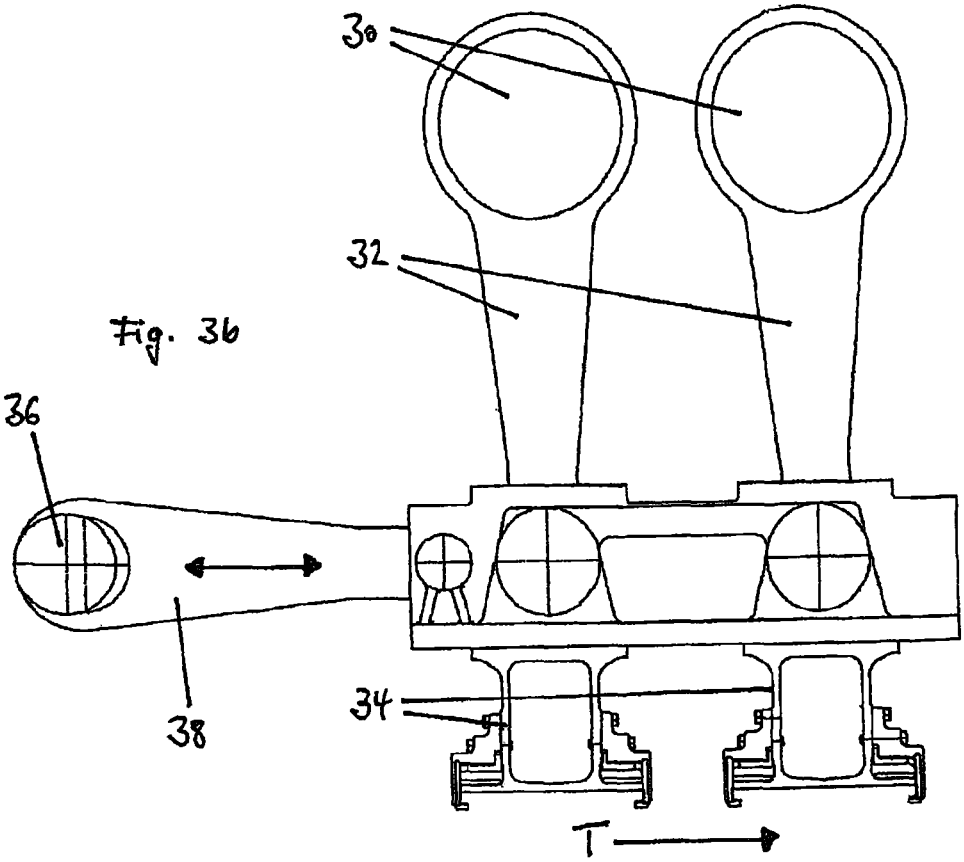

One possible structure parameter of the second needling device 4, the adaptation of which can lead to a homogenization of the stitching of the needle fleece 6, is, for example, the distance between the second needling device 4 and the first needling device 2 in the transport direction T of the fleece 6. FIGS. 3*a* and 3*b* show by way of example an arrangement for shifting the position of the second needling device 4 in the transport direction T. In addition to the components of the second needling device 4 already shown in FIG. 2, this device comprises here in addition a cam arrangement 36, by means of which a substantially horizontally oriented conrod 38 can be moved either in the transport direction T of the fleece 6 or in the opposite direction and then locked in position. The conrod 38 is articulated to the needle bar 34 so as not to limit the functionality of the second needling device 4. In addition to the illustrated cam arrangement 36, the person skilled in the art will easily be able to discover many other possible ways of effectively adjusting the distance between the second needling device 4 and the first needling device 2 with millimeter precision. The embodiment shown here offers the advantage that the distance can be adapted while the machine is in operation.

Figure 4:
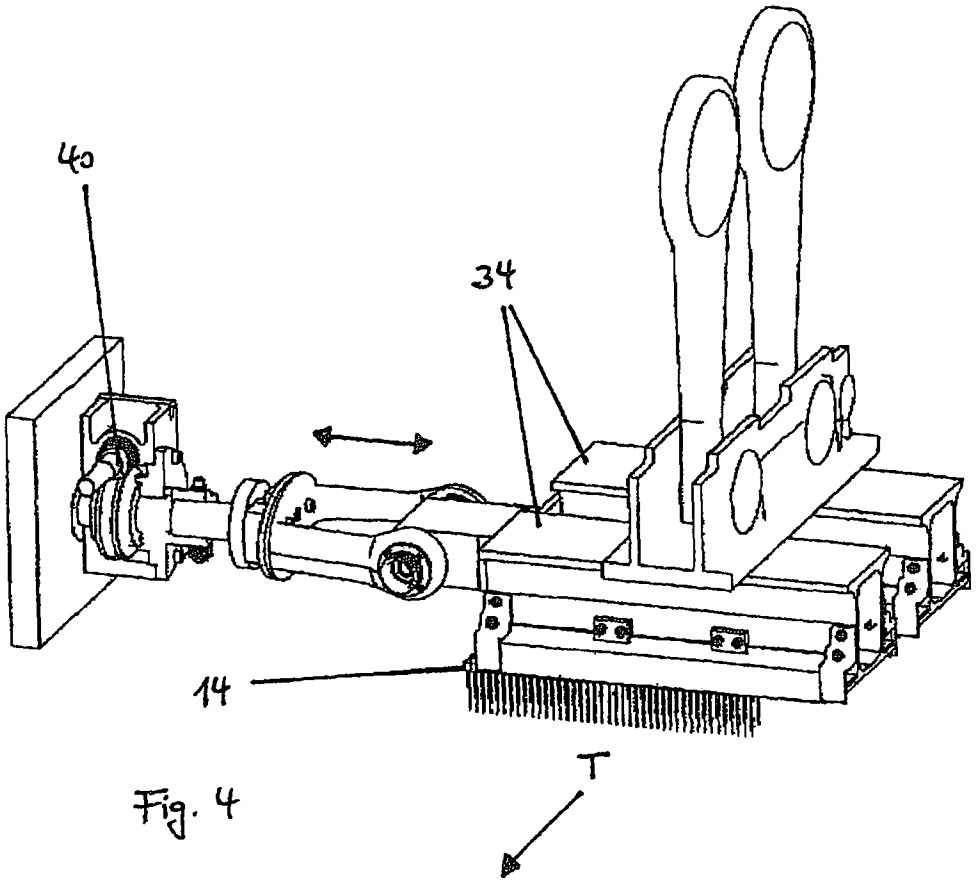
FIG. 4 is a schematic perspective view of a needle assembly in the second needling device similar to that of FIG. 2, wherein a lateral positioning of the at least one needle board transversely to a transport direction of the fleece is also possible.

Another structure parameter of the second needling device 4 which can be adapted according to the invention to homogenize the stitching of the needled fleece 6 is the lateral positioning of the at least one needle board 14 in the second needling device 4 transversely to the transport direction T of the fleece 6. An example of a suitable shifting mechanism is shown in FIG. 4. In the example shown here, the shift mechanism comprises a spindle arrangement 40, by means of which the needle board 14 of the second needling device 4 can be pushed transversely to the transport direction T of the fleece 6. The spindle arrangement 40 can preferably be driven by a drive controlled by the control unit 22. This adaptation can be carried out while the machine is operating. Many other mechanisms which can be used to shift the needle board 14 sideways in the second needling device 4 can be imagined. For example, in the embodiment shown, the shift mechanism grips the needle bar 34 of the needling device 4, but it is also possible for the lateral shift mechanism to be connected directly to a needle board 14 which is clamped pneumatically to the needle bar 34.

Another structure parameter of the second needling device 4, the adaptation of which can lead to a homogenization of the stitching in the needled fleece 6, is the arrangement of the needles in the at least one needle board 14 of the second needling device 4. Because a needle board has a very large number of possible needle positions, the variability in the needle arrangement forms an especially effective variant for improving the stitching pattern.

A first option for varying the needle arrangement in the needle board 14 is to equip a conventional needle board 14 partially with needles 16, which are introduced specifically only into the bores calculated by the control unit 22, whereas the other bores of the needle board 14 remain unoccupied. The specific, partial fitting-out of the needle board 14 can be carried out manually or by means of a pick-and-place robot, controlled by the control unit 22.

Another option for varying the arrangement of needles in the needle board 14 is an arrangement in which the needles 16 in the area of the at least one needle board are horizontally shiftable. There are several ways in which this principle can be implemented.

Figure 5:
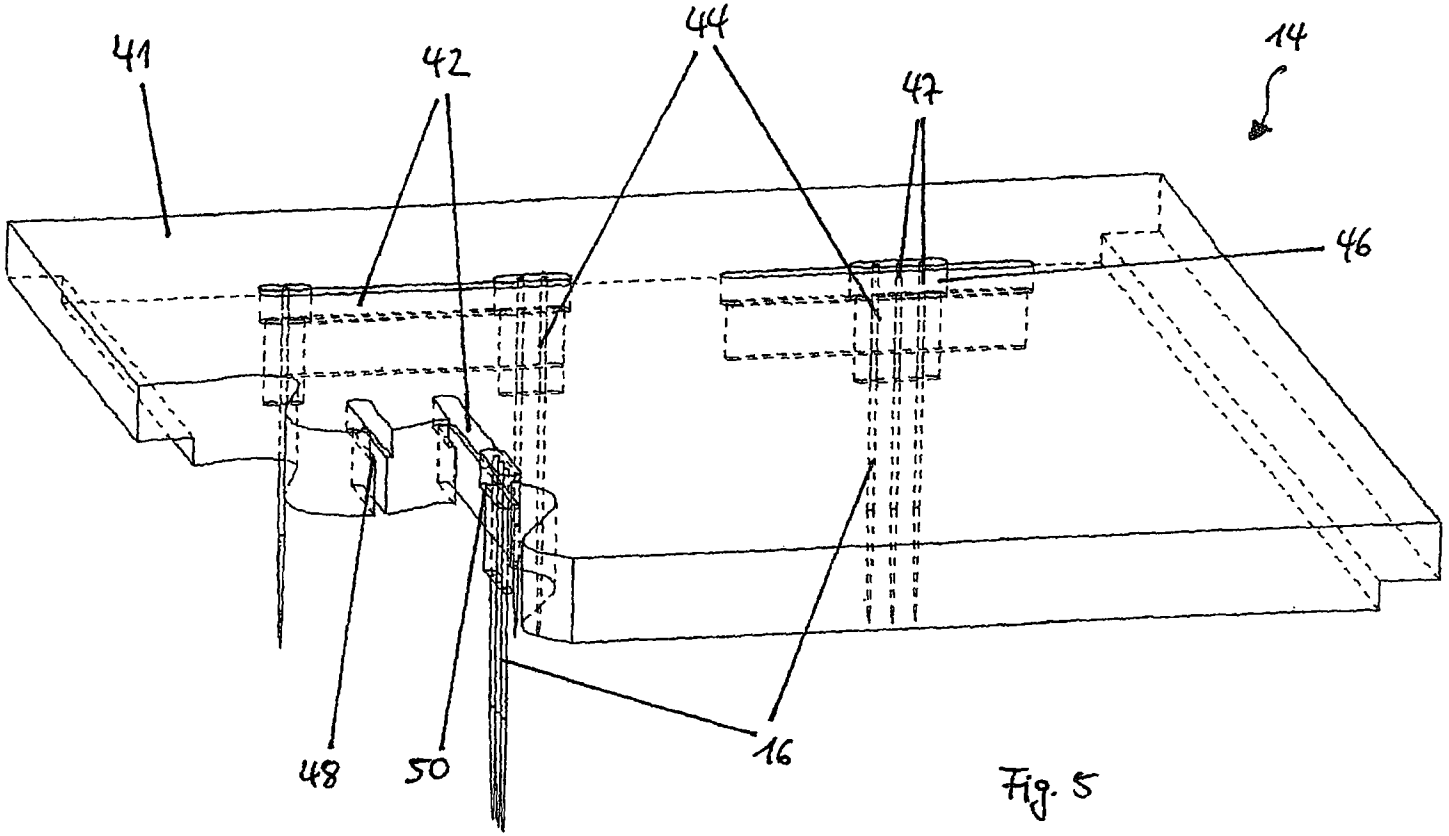
FIG. 5 is a schematic perspective view of a needle board of the second needling device, in which individual needle modules are horizontally shiftable in a carrier plate of the needle board.

A first possibility is illustrated in FIG. 5. The needle board 14 shown here comprises a base plate 41, in which several horizontally oriented slots 42 are arranged. FIG. 5 shows by way of example four slots, two of which extend in a first direction, while two others extend in a second direction perpendicular to the first direction. The arrangement of the slots 42 in the needle board 14 can be selected in any way desired, however, and any number of slots 42 extending in any desired directions can be present. Needle modules 44 are arranged to be horizontally shiftable in the slots 42. Each needle module 44 comprises a carrier element 46, preferably of plastic, which comprises one or more recesses 47, in which the shafts of one or more needles 16 are held. The carrier element 46 can be injection-molded, for example, onto the needles 16. The tips of the needles project from the recesses 47. Each slot 42 comprises a circumferential shoulder 48, preferably in its wall area, as can be seen most clearly in the cut-away area at the bottom left in FIG. 5. Projecting edge sections 50 of the carrier element 46 rest on these shoulders 48. US 2010/0162543 A1 describes other ways in which the needle modules 44 can be configured, the content of this document being herewith included in its entirety by reference.

The individual needle modules 44 can now be shifted in the slots 42, and after they have reached the correctly shifted position, the needle modules 44 are clamped in place by forces acting between the needle board 14 and the associated needle bar 34 (FIG. 1). As can be seen in FIG. 5, several needle modules 44 can also be arranged in one slot 42.

Figure 6:
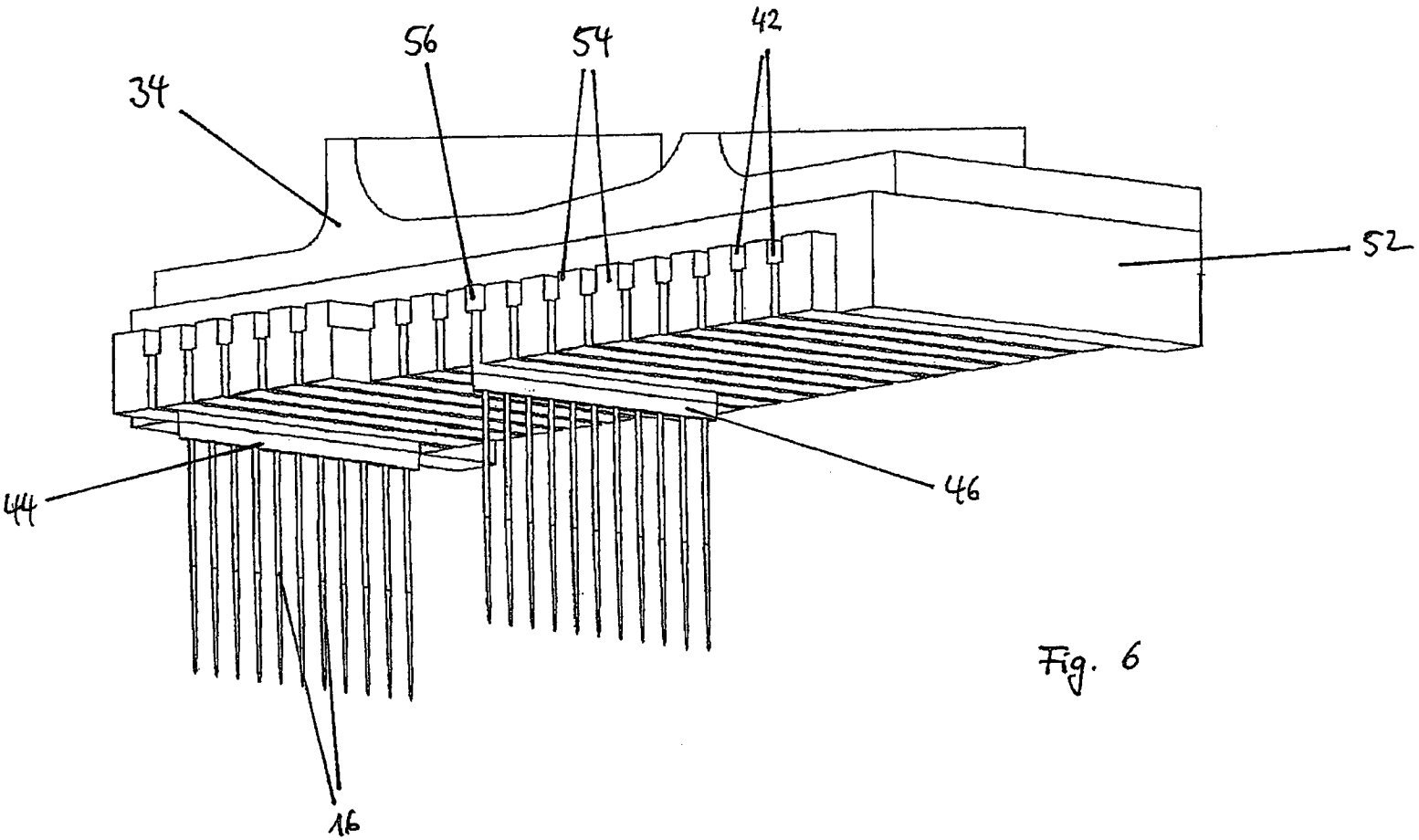
FIG. 6 is a schematic perspective view of a needle board of the second needling device, in which several needles gathered into a comb-like structure are arranged so as to be shiftable in the needle board and are held in position by a magnetic plate.

FIG. 6 shows schematically another way in which the needles 16 of the second needling device 4 can be arranged shiftably in the needle board 14. In this embodiment, a magnetic plate 52 is fastened to the needle bar 34. The needle board 14 consists of several ferromagnetic needle board segments 54, which can be held in position on the magnetic plate 52. In the present case, the needle board segments 54 are arranged transversely to the transport direction T of the fleece 6, and the slots 42 defined between them serve to accept needle modules 44. Each needle module 44 comprises a plurality of needles 16, which are connected to a carrier element 46. The carrier element 46 can, as shown in FIG. 6, project slightly downward from the associated slot 42, but it can also be fully accommodated in the slot 42.

At its end area, the carrier element 46 comprises a widened head section 56, which is held shiftably in, and guided by, a correspondingly widened section of the associated slot 42. Preferably at least the head section 56 is ferromagnetic. In the assembled state, the head sections 56 of the needle modules 44 are then held in place on the magnetic plate 52. For further possible configurations of the needle modules 44 used here, reference is made again to US 2010/0162543 A1, the content of which is to be included here in its entirety by reference.

It should be pointed out here that details of the embodiments shown in FIGS. 5 and 6 can be combined with each other in any desired way.

Figure 7:
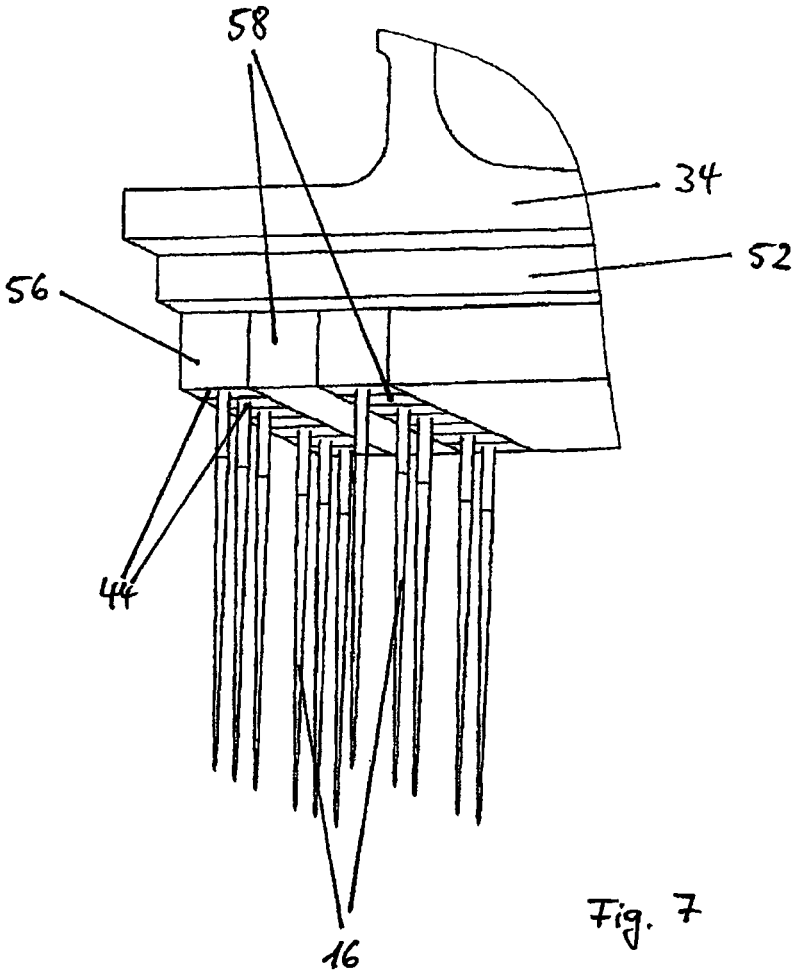
FIG. 7 is a schematic perspective view of part of a needle assembly of the second needling device, in which ferromagnetic heads of the needles are held in any desired arrangement on a magnetic plate.

FIG. 7 shows another possible embodiment of a variable, shiftable arrangement of needles 16 in the area of the needle board 14 of the second needling device 4. In the example shown, each needle module 44 comprises only one needle 16, but it can also comprise several needles 16. Each needle module 44 comprises a head section 56, which is ferromagnetic. When the magnetic plate 52 is turned off, the needle modules 44 are shiftable, i.e., can be repositioned; and when the magnetic plate 52 is turned on, they can be held in place in any desired location on the magnetic plate 52. Intermediate spaces between individual needle modules 44 can be bridged by intermediate pieces 58 to provide stabilization. The intermediate pieces 58 can preferably also be ferromagnetic.

Figure 8A:
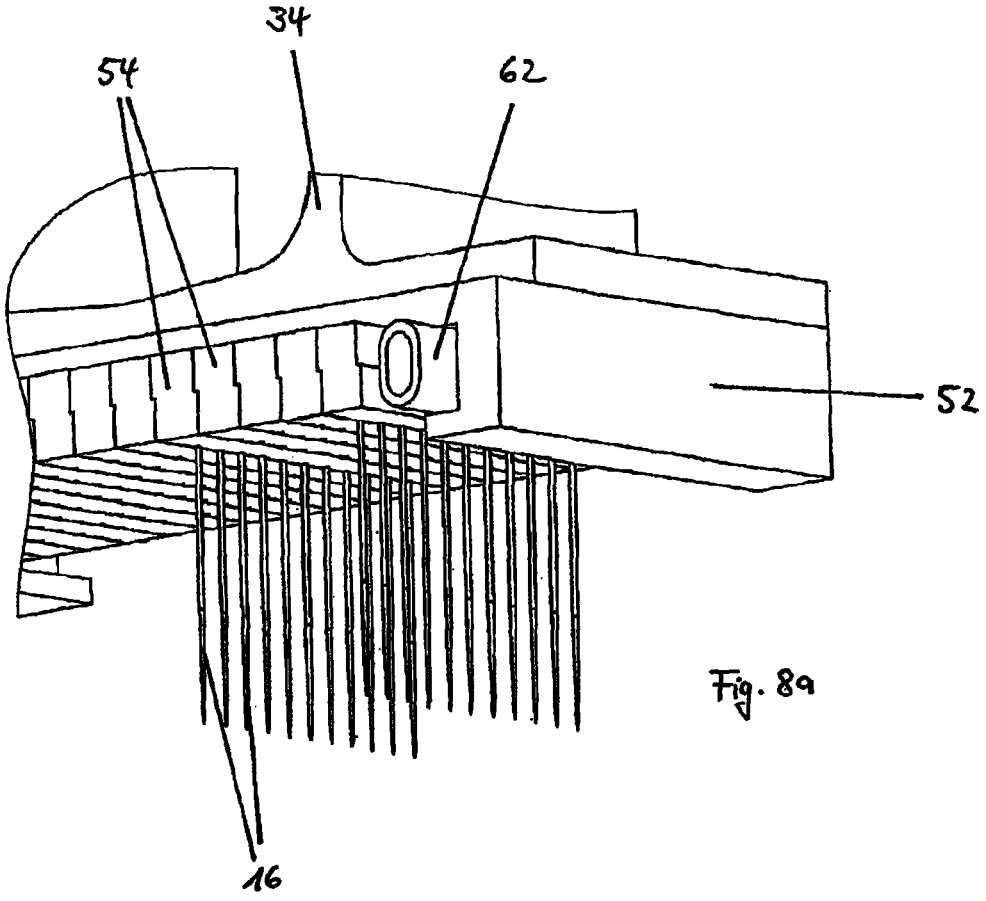
FIG. 8*a* is a schematic perspective view of part of a needle assembly of the second needling device, in which the needle board consists of several needle board segments, which are held in position on a magnetic plate.
Figure 8B:
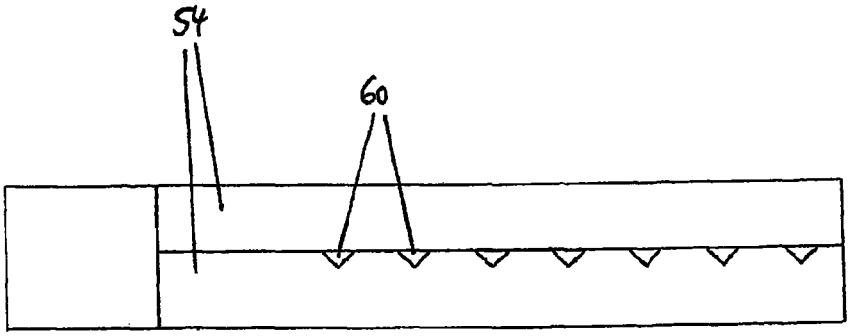
FIG. 8*b* is a plan view (from above) of two adjacent needle board segments as shown in FIG. 8*a*.

The variant shown in FIG. 8*a* shows individual needle board segments 54, at least many of which are ferromagnetic and held in place on a magnetic plate 52. In the example shown here, at least many of the needle board segments 54 comprise recesses 60 (see top view in FIG. 8*b*), which serve to accept variable arrangements of individual needles 16. The recesses 60 are configured in an edge area of the associated needle board segment 54, so that, after complete assembly as shown FIG. 8*a*, the recess 60 in question is bordered by the adjacent needle board segment 54. By providing the upper end of each recess 60 with a suitable shape such as the shape of a prism and by giving the needle heads a corresponding configuration, the individual needles 16 are held firmly in place in the recesses 60 between two needle board segments 54 and the magnetic plate 52.

Between the magnetic plate 52 and the needle board segments 54, furthermore, a clamping force can act in the horizontal direction by means of, for example, a pneumatically activatable air hose 62. This is necessary especially in cases where a large number of the needle board segments 54 are made of plastic or of aluminum, for example, and therefore do not adhere magnetically to the magnetic plate 52. A clamping device of this type can also be used in the embodiment according to FIG. 7.

Figure 9:
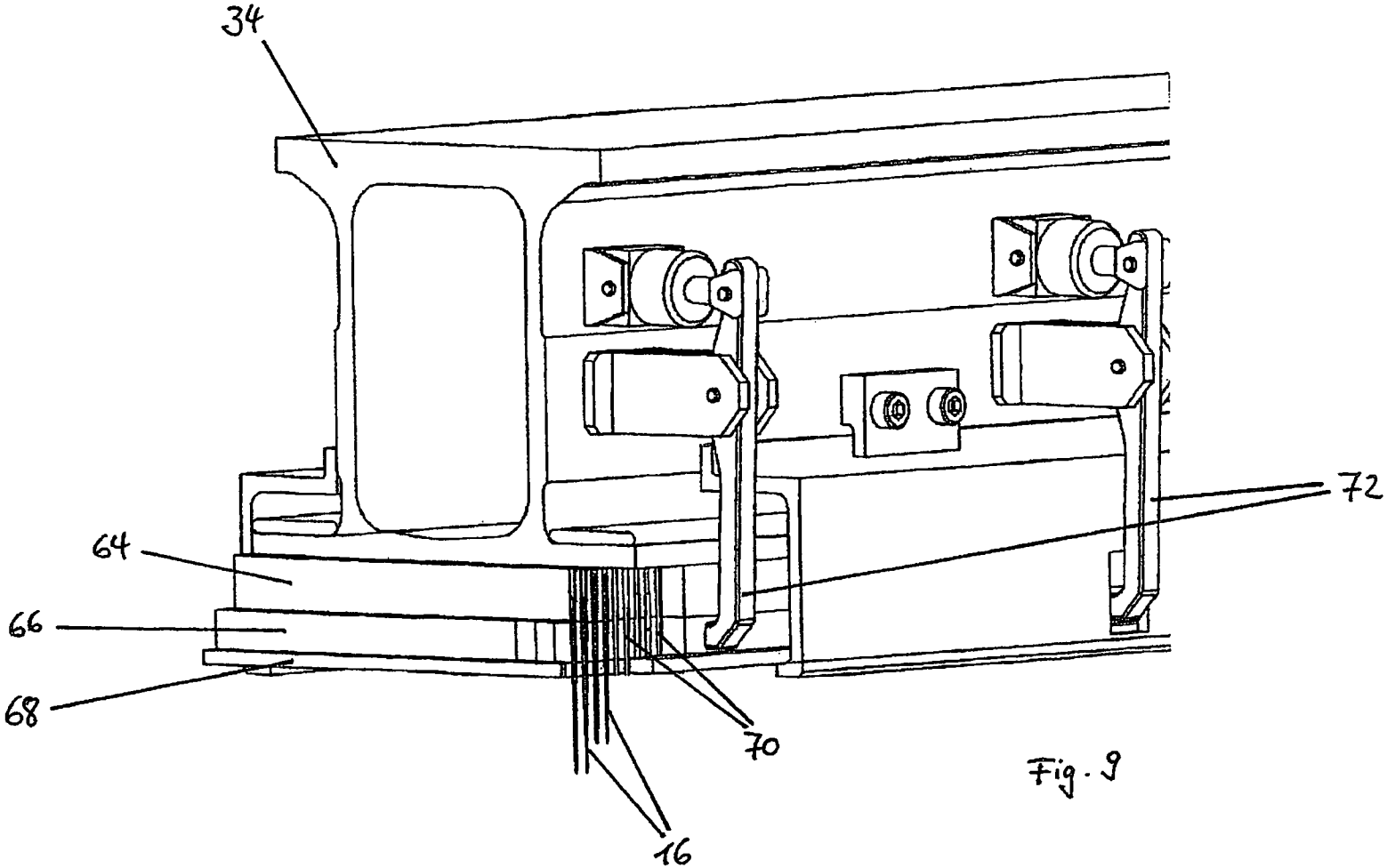
FIG. 9 is a schematic perspective view of a needle assembly in the second needling device, in which the individual needles are vertically shiftable.

Another possible way of variably arranging the needles in the needle board 14 is to shift the needles 16 in at least one needle board 14 vertically. An example of this type of embodiment is shown in FIG. 9. The front right corner area of the needle board 14 is shown cut away, so that the arrangement of the needles 16 in the interior of the needle board 14 can be seen.

In the embodiment shown in FIG. 9, the needle board 14 comprises three layers 64, 66, and 68, each of which comprises bores 70, which are aligned with each other, for the individual needles 16. The needles 16 are arranged to be vertically shiftable inside these bores 70, in such a way that in all cases they pass through the lower layer 68 and the middle layer 66 and extend into the upper layer 64 of the needle board 14, wherein they can be pushed to different degrees into the upper layer 64 of the needle board 14. FIG. 9 shows four needles 16. The two needles 16 on the left have not been pushed into the upper layer 64 of the needle board 14 as deeply as the two needles 16 on the right.

In the example shown, the needles 16 are held in place by means of several levers 72, which exert a horizontal force on the middle layer 66 of the needle board 14 and thus clamp the needles 16 passing through the middle layer 66 against the upper plate 64 and the lower plate 68 of the needle board 14. The middle layer 66 of the needle board 14 can, as in the example shown, have a one-piece configuration, or it can be segmented. With this arrangement, the height of the individual needles 16 can be adjusted and fixed in place. The individual needles 16 are thus activated for engaging in the fleece 6 by pulling them downward, and they are deactivated by pulling them upward. Several other possible ways of vertically shifting the needles 16 in the needle board 14 can also be imagined.

The variants of the variable needle arrangement in the needle board shown in FIGS. 5-9 can be implemented only while the machine is at a standstill. When such a change is to be made, the preferred arrangement of the needles 16 in the needle board 14 of the second needling device 4 to be implemented is displayed to the operator on a screen 24, or appropriate devices for automatically positioning the needles 16 in the needle board 14 are actuated by the control unit 22 on the basis of the results of the detector 20.

Up to now, only a first needling device 2 and a second needling device 4 have been discussed. It is obvious that additional needling devices can also be used within the scope of the invention.

Many other modifications and configurations of the details concerning the adjustment possibilities of the operating parameters and/or of the structure parameters of the second needling device 4 will occur to the person skilled in the art.

In certain cases, the adjustment of only one of the cited parameters can be sufficient or advantageous, but several of the cited parameters can also be adjusted simultaneously within the scope of the invention.

The invention claimed is:

1. A needling machine for needling a fleece comprising a needle board including needles wherein the needles are arranged in an area of the needle board, the needles being horizontally shiftable relative to the needle board in a transport direction of the fleece, while at the same time the needles are restrained from moving in a horizontal direction perpendicular to the transport direction.

2. The needling machine of claim 1 wherein the needle board comprises:

a base plate including a plurality of horizontally oriented slots; and needle modules with one or more needles, each of the needle modules having a carrier element with one or more recesses in which shafts of one or more of the needles are held, the needles having tips which project from the recesses and the needle modules are arranged to be horizontally shiftable in the slots.

3. The needling machine of claim 2 wherein the carrier element is made of plastic.

4. The needling machine of claim 2 wherein the carrier element is injection-molded onto the needles.

5. The needling machine of claim 2 further including a circumferential shoulder in a wall area of each slot and a projecting edge section of the carrier element, the projecting edge section rests on the shoulder.

6. The needling machine of claim 2 wherein a plurality of needle modules are arranged in one slot.

* * * * *